United States Patent [19]

Michassouridis et al.

[11] Patent Number: 4,473,037

[45] Date of Patent: Sep. 25, 1984

[54] COOLING CIRCUIT FOR INTERNAL COMBUSTION ENGINES

[75] Inventors: Athanasios Michassouridis, Munich; Erwin Schweiger, Dachau; Erwin Starmühler, Munich; Peter Tomaschek, Seefeld, all of Fed. Rep. of Germany

[73] Assignee: Bayerische Motoren Werke A.G., Fed. Rep. of Germany

[21] Appl. No.: 513,904

[22] Filed: Jul. 14, 1983

[30] Foreign Application Priority Data

Jul. 15, 1982 [DE] Fed. Rep. of Germany ..... 3226509

[51] Int. Cl.[3] ..... F01P 7/16

[52] U.S. Cl. ..... 123/41.1; 123/41.27; 123/41.54

[58] Field of Search ..... 123/41.02, 41.08, 41.09, 123/41.1, 41.27, 41.44, 41.54

[56] References Cited

U.S. PATENT DOCUMENTS

| | | | |
|---|---|---|---|
| 1,311,809 | 7/1919 | Giesler | 236/34.5 |
| 2,799,260 | 7/1959 | Butler | 123/41.54 |
| 2,841,127 | 7/1958 | Baster | 123/41.1 |
| 3,601,181 | 8/1971 | Avrea | 123/41.27 |
| 3,726,262 | 4/1973 | Moon | 123/41.1 |
| 3,981,279 | 9/1976 | Bubniak et al. | 123/41.02 |
| 4,167,159 | 9/1979 | Warman | 123/41.08 |

FOREIGN PATENT DOCUMENTS

| | | |
|---|---|---|
| 896850 | 5/1962 | United Kingdom . |
| 2083609 | 3/1982 | United Kingdom . |

*Primary Examiner*—William A. Cuchlinski, Jr.
*Attorney, Agent, or Firm*—Craig & Burns

[57] ABSTRACT

In a cooling circuit for internal combustion engines which includes a cooling jacket of the engine, a coolant pump, a radiator, a mixing thermostat, and an expansion tank, an excess-pressure valve is connected in the area between the cooling jacket and the radiator and a vacuum valve is connected in the area between the radiator valve of the mixing thermostat and the suction side of the coolant pump; both valves are connected with the coolant reservoir in the expansion tank which in communication with the atmosphere, is without excess pressure; high excess pressure values as well as low vacuum values in the cooling circuit are precluded thereby; a vent valve provides for an especially effective venting of the cooling circuit into the expansion tank in cooperation with the sucking back of coolant into the cooling circuit by means of the vacuum valve.

11 Claims, 3 Drawing Figures

18'
19'
19
20
18"
18
17'
21'
17"
17
22
4
23
7
5
5
5
2
20
8
6
1
21
10
9
14
3
16
15
13
12
11

6"
18
22'
7'
6'
11'

18
22'
11'
23

COOLING CIRCUIT FOR INTERNAL COMBUSTION ENGINES

The present invention relates to a cooling circuit for internal combustion engines with a cooling medium pump, with a radiator, with a by-pass line of the radiator, with an excess pressure valve and a vacuum valve for limiting the maximum and minimum pressure in the cooling medium circuit, and with a cooling medium reservoir.

In a conventional cooling circuit of this type of construction according to ATZ 83 (1981), issue 3, pp. 113 and 115, the excess-pressure and vacuum valves are conventionally combined with a filler pipe cap-like cover which closes off the filling opening of an additional expansion tank lying in the bypass pressure circuit. By way of a filling line from the expansion tank to the mixing chamber of the mixing thermostat and to the directly adjoining coolant pump, the excess-pressure and vacuum valves are connected during operation, with a relatively low pressure difference or pressure drop from the flow resistance, with the suction side of the coolant pump respectively the suction pressure thereof. The expansion tank, open to the atmosphere, is connected in series with the excess-pressure and vacuum valves as water reservoir which assures the complete venting of the cooling circuit by reason of the volume changes during the warm-up and cooling-down phases. In addition to the high constructional expenditure of this conventional cooling circuit, the latter has the additional drawback that, during constant warm-up with a volume increase of the coolant and with a simultaneously constantly high pump speed accompanied by high pressure buildup as well as with a rise in the radiator flow resistance due to aging and/or soiling, the highest occurring pressure load on the inlet side of the radiator increases far above the normal operating value and may even lead to destruction of the aging and/or soiled radiator.

In another conventional cooling circuit of known construction, passenger car model Toyota-Tercel, the aforementioned disadvantages are eliminated because the filling closure with excess-pressure and vacuum valves is arranged in a likewise conventional manner at the radiator inlet water box. However, as a result thereof, on the one hand, a relatively small pressure build-up with an unfavorable cooling function results and, on the other hand, the vacuum valve also lies in the excess pressure area of the cooling circuit so that a sucking back of coolant from the expansion tank by suction is disadvantageously possible only in the cooling-off phase of the turned off engine. During the operation and after brief operating pauses with partial cooling-off and partial pressure drop in the cooling circuit, however, a vacuum occurring on the suction side of the coolant pump cannot be compensated for, so that vapor bubble formations can occur with a drop in the delivery output of the pump up to the standstill of the coolant feed as well as a strong pump cavitation with an increase in wear up to inoperability of the coolant pump as also air can enter by way of the pump seals.

The present invention is concerned with the task of improving the pressure control of the cooling circuit in such a manner that too high as well as too low pressure values are avoided without having to forego the advantages of uniform temperature regulation by the mixing thermostat.

The underlying problems are solved according to the present invention in that the excess pressure valve is connected to the cooling circuit within the area between the cooling jacket of the engine and the radiator and in that the vacuum valve is connected to the cooling circuit between the radiator valve of the mixing thermostat and the suction side of the coolant pump. This precludes pressure values in the cooling circuit which are too high as well as too low, without deleteriously affecting other advantageous properties of the same.

In a conventional cooling circuit of a similar construction according to U.S. Pat. No. 2,799,260, one excess-pressure valve and one vacuum valve each are disposed in the filling closure member at the radiator inlet water box, and another vacuum valve is arranged in an additional connecting line between the expansion tank and the suction side of the coolant pump. Admittedly, certain features of the present invention are thus known from this patent, however, in this prior art cooling circuit no mixing thermostat is provided nor any thermostat at all which, by its various arrangement possibilities and its various valve positions exerts an essential influence on the pressure development in the cooling circuit and also on the function of the excess-pressure and vacuum valves. The combination of a radiator valve of a thermostat, customarily arranged predominantly in the intake, with the arrangement of the excess-pressure and vacuum valves at the inlet or return water box of the radiator, leads to rendering without function a vacuum valve additionally connected to the suction side of the coolant pump. This results from the reaction of the suction pressure of the coolant pump up to the radiator valve of the thermostat, closed during the warmup phase of the engine, whereby the vacuum valve arranged in the filler closure member of the radiator has the same function as the additional vacuum valve, making the latter superfluous (SAE Report 65 04 471, p. 14).

The combination according to this invention of an arrangement with a vacuum valve, known for some time, with the arrangement of the radiator valve of a mixing thermostat in the radiator return, also known for some time (U.S. Pat. No. 1,311,809), was thus neither suggested nor made obvious from the known prior art in conjunction with the not readily forseeable function.

If a vent line with a vent valve leads from a high point between the cooling jacket and the radiator to the expansion tank, which opens by gravitational interaction and closes by the influence of the level height, the flow and/or the pressure of the coolant, then a rapid venting, especially after filling the cooling circuit, is attained whereby air is conveyed through the opened vent valve to the expansion tank, and, from the latter coolant is fed by way of the vacuum valve into the cooling circuit until the vent valve is closed after the air has escaped from the coolant. The arrangement of the vent valve at the high point of the return water box of a cross flow radiator further enhances the venting effect, because an especially advantageous air separating place is utilized thereby (SAE Report 65 04 471).

The construction of the vent valve as float valve in which at least at low excess pressure values, the product sealing seating area and pressure difference acting thereon is smaller than the weight of the float itself provides venting even in case of excess pressure in the cooling circuit. A fine screen filter on the inlet side of the vacuum valve and/or of the vent valve precludes leakage of the valves.

These and other objects, features and advantages of the present invention will become more apparent from the following description when taken in connection with the accompanying drawings, which show, for the purposes of illustration only, several embodiments in accordance with the present invention, and wherein.

Figure 1:
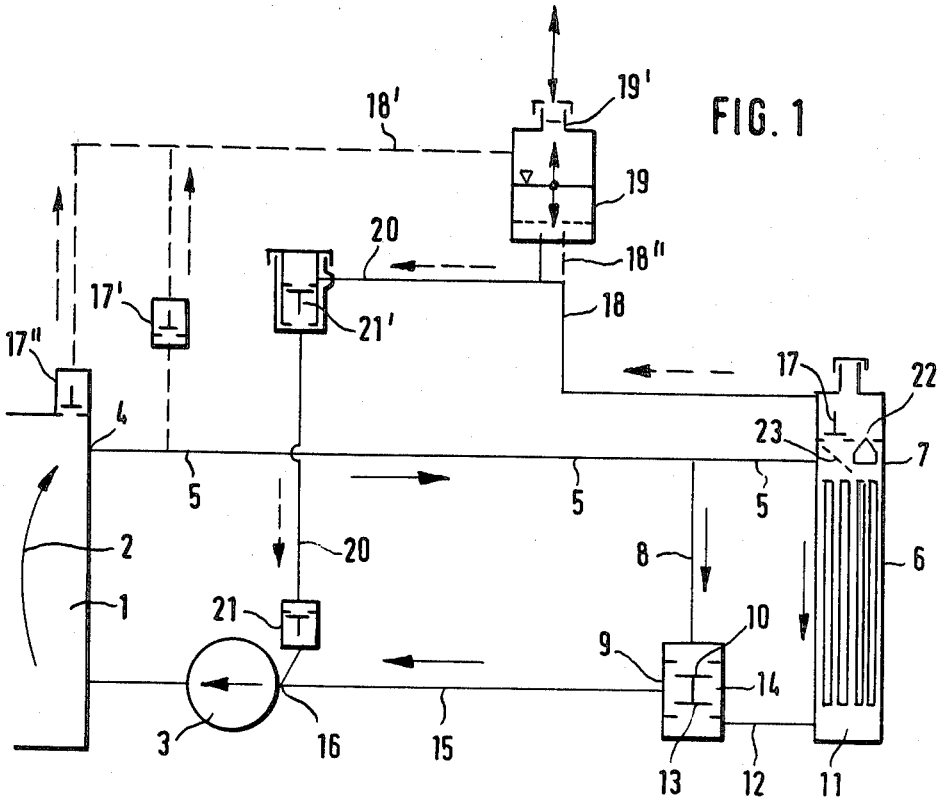
FIG. 1 is a schematic view of a cooling circuit for internal combustion engines in accordance with the present invention.

Referring now to the drawing wherein corresponding reference numerals are used in the various views to designate corresponding parts, an internal combustion engine 1 comprises a cooling jacket indicated by an arrow 2, into which the coolant is fed under pressure by means of a coolant pump 3. An inlet 5 is connected to the outlet 4 of the cooling jacket 2 as a line connection with free passage to a radiator 6. The inlet 5 terminates in a radiator inlet water box 7. A bypass 8 branches off from the inlet 5 and ends in a mixing thermostat 9, whereby this discharge orifice is controlled by a bypass valve 10 of the mixing thermostat 9. A line constituting the return 12 from the radiator 6 leads from a radiator return water box 11 into the mixing thermostat 9, which includes a radiator valve 13 for controlling the inflow orifice of the return 12. A suction line 15 leads from a mixing chamber 14 of the mixing thermostat 9 to the suction side 16 of the coolant pump 3.

An excess-pressure valve 17 is arranged at the radiator inlet water box 7 which is connected by means of a discharge line 18 into an expansion tank 19 open with respect to the atmosphere which is equipped with a slotted sealing disk 19' in its filling opening to prevent evaporation of the coolant. The excess-pressure valve 17 can be connected alternatively (17' or 17'') at the inlet 5 or at the cooling jacket 2 of the engine 1. The expansion tank 19 is connected with the suction side 16 of the coolant pump 3 by way of an auxiliary suction line 20 and a vacuum valve 21 preferably responding pressureless as a check valve. While the discharge line 18 may also be connected alternatively (18') to the upper area of the interior space of the expansion tank 19, the auxiliary suction line 20 exits in proximity of the bottom from the interior space of the expansion tank 19. The discharge line 18 may finally, also terminate separately (18'') in the expansion tank 19 in proximity of the bottom of the latter. The vacuum valve 21' can be combined into a structural unit with a filler pipe.

Figure 2:
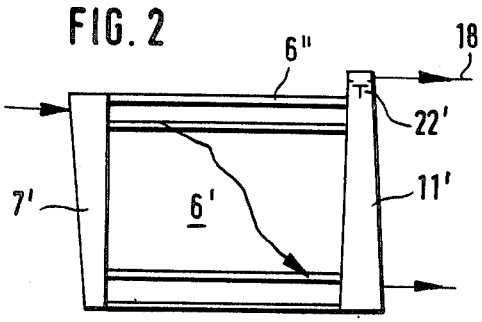
FIG. 2 is a schematic view of a cross-flow radiator as partial alternative in the cooling circuit of FIG. 1.
Figure 3:
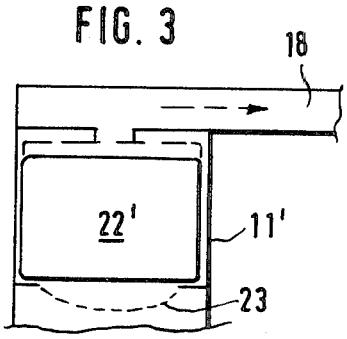
FIG. 3 is a schematic view of a float valve as vent valve in the cooling circuit of FIG. 1.

A vent valve 22 is connected with the discharge line 18 in parallel to the excess-pressure valve 17 or 17' or 17'', which is opened under the effect of gravity in the presence of air and of a pressureless cooling circuit, due to its construction as a breather, check, or float valve. According to FIG. 2, this vent valve 22' is arranged at the high point of the return water box 11' of a cross-flow radiator 6', from which starts the discharge line 18. A cross-flow radiator 6' is suitable for this arrangement for an especially effective venting of the cooling circuit because only a very small coolant flow in the return water tank 11' is produced from its inlet water box 7' through the uppermost radiator tubes 6'', which enhances a separation of air in the area of the vent valve 22'. The vent valve 22'' according to FIG. 3 may be constructed, independently of its arrangement, in correspondence with the excess-pressure valve 17, 17', or 17'' and the vent valve 22 or 22', as a float valve whose sealing seat surface is so matched with the inherent weight of the float that the float valve 22'', in case of accumulation of air, also opens if relatively low excess pressure values prevail in the cooling circuit. As a result thereof, a venting of the cooling circuit also during the operation of the engine under relatively low load is assured. A tight closing off of the cooling circuit with attained venting is also assured in this case so that the vent valve 22'' is constantly tightly closed except after a refilling of the cooling circuit or after any other automatic venting. A relatively large-sized fine-screen filter 23 additionally prevents the valves from leaking due to dirt particles.

During the operation of the internal combustion engine 1, which customarily begins with a cold start after a relatively long cooling-off period, at which the likewise cooled-off coolant content of the entire cooling circuit has a certain minimum volume, the expansion tank 19 contains a corresponding minimum volume. This is so as during the preceding cooling-off, a volume of coolant corresponding to the shrinkage in volume flows from the expansion tank 19 through the auxiliary suction line 20 and through the vacuum valve 21 as well as through the coolant pump 3 into the cooling circuit, which otherwise is sealed off all around by the excess-pressure valve 17 and is composed of the cooling jacket 2, the inlet 5, the radiator 6, the return 12, the suction line 15 and the bypass 8. The content of the expansion tank 19 is, for this reason, so dimensioned that at the locally prevailing lowest ambient temperatures, a complete emptying of the expansion tank 19 is far-reachingly precluded. However, the cooling circuit is still operable unchanged, even if at extraordinarily low ambient temperatures, a certain amount of air is sucked into the cooling circuit because, owing to the volume expansion of the coolant occurring during warm-up of the engine, this proportion of air is displaced again into the expansion tank by the excess-pressure valve 17 before the operating temperature has been reached.

The total volume of the expansion tank 19, finally, is determined additionally by the total content of the cooling circuit, the maximum possible thermal expansion of the coolant in the cooling circuit and an additional storage volume for a quantity possibly ejected due to overheating through the excess-pressure valve 17.

During starting of the cooled-off engine, the first rotational speed rise immediatly leads to the build-up of a delivery level for the coolant pump 3, which effects, on the one hand, a drop in the pump suction pressure to below the ambient pressure existing in the entire cooling circuit prior to the start, and, on the other hand, a build-up of an excess pressure in the cooling circuit sections connected downstream of the coolant pump 3, namely in the cooling jacket 2, the inlet 5, bypass 8, radiator 6, and the return 12. While this excess pressure does not attain the opening pressure value of the excess-pressure valve 17, coolant is sucked from the expansion tank 19 into the cooling circuit through the vacuum valve 21, responding to the slightest pressure difference, and through the auxiliary suction line 20 for such length of time until the ambient pressure is reached on the suction side 16 of the coolant pump 3. During this operation, the excess pressure in the parts of the cooling circuit located downstream of the coolant pump 3 continues to rise at the same time. The elastic hose lines and any possible residual air occlusions in this area thereby enable an increase of the volume of coolant contained therein, which is sucked back during this operation from the expansion tank 19.

During the further operation of the internal combustion engine 1, the coolant temperature rises continuously due to heat transfer in the cooling jacket 2, until the opening temperature value of the mixing thermostat 9 of about 80° C. has been reached. This is followed by the control range of the mixing thermostat 9 with increasing opening of the radiator valve 13 and closing of the bypass valve 10 as well as with an increasing flow through radiator 6. A further rise in temperature to above approximately 90° C. leads past the control range of the mixing thermostat 9 with a closed bypass valve 10 to a throughflow solely through the radiator 6 accompanied by an increased throughflow quantity, flow velocity, heat removal and also increased flow resistance and pressure build-up in the inlet 5 and in the radiator inlet water box 7. Depending on the volume content and elasticity of the cooling circuit, especially of the hose line of the inlet 5, of the bypass 8, of the return 12, and of the suction line 15 as well as furthermore depending on the initial temperature of the coolant during the staring operation, the excess pressure opening value of the excess-pressure valve 17 is attained more or less early before or after the opening of the radiator valve 13 of the mixing thermostat 9. The delivery level of the coolant pump 3 occurring in dependence on the instantaneous rotational speed of the engine 1 is thereby also decisive. The pressures occurring in the cooling circuit at various locations are determined by the excess-pressure valve 17 in conjunction with the pressure differences from and to the coolant pump 3. The respectively highest pressure differences occur in the two cooling circuit sections in each case at maximum engine speed, whereas, the pressure differences are very small at a minimum idling speed of the engine and thus, just as when the engine 1 is turned off, the entire cooling circuit can assume an excess pressure corresponding to the opening pressure value of the excess-pressure valve 17.

Thus, on the whole, an internal pressure can occur regularly in the cooling circuit ranging from ambient pressure to the opening pressure value of the excess-pressure valve 17 as well as an excess pressure exceeding this first-mentioned pressure can occur during operation of the engine 1 in the cooling jacket 2 and in the inlet 5 as well as in the bypass 8, which is dependent on the flow resistance of the cooling circuit. The unequivocal limitation of the maximum and minimum pressure values in the radiator inlet water box 7 and on the suction side 16 of the coolant pump 3, respectively, avoid, on the one hand, pressure overloads of the radiator 6 with corresponding overdimensioning in its strength, and, on the other hand, preclude a pressure drop with increased danger of cavitation in the coolant pump.

Moreover, depending on the arrangement of the excess pressure valve 17, 17' or 17'' in the direction of the pressure development in the cooling circuit, which may vary with the flow direction of the coolant, and by adaptation of the pressure value of the excess-pressure valve to this pressure development, a differently high excess pressure uniform throughout the entire cooling circuit is available after the engine has been shut off, which counteracts vapor formation during reheating, respectively, temperature equalization between the engine and the coolant. This is true although the pressure development during operation remains respectively unchanged, on account of the pressure value adapted to the point of installation. The best effect along these lines is attained by connecting the excess-pressure valve 17'' directly to the cooling jacket 2 itself because the relatively high excess pressure value prevailing during operation upstream of its outlet 4 is also available thereby in the entire cooling circuit after the engine has been turned off as a highest possible static excess pressure value. A pressure overload of the remaining cooling circuit parts, however, does not occur by this exclusively statically effective excess pressure, as contrasted to dynamic surge and fluctuating loads.

While we have shown and described several embodiments in accordance with the present invention, it is understood that the same is not limited thereto but is susceptible of numerous changes and modifications as known to one having ordinary skill in the art, and we therefore do not wish to be limited to the details shown and described herein, but intend to cover all such changes and modifications as are encompassed by the scope of the appended claims.

We claim:

1. A cooling circuit for internal combustion engines, comprising a coolant pump at the inlet into a cooling jacket of the engine, a radiator constructed as a heat-exchanger between coolant and surrounding air and/or external cooling fluid, the inlet of said radiator being connected to the outlet of the cooling jacket and the return of said radiator being connected by way of a radiator valve of a mixing thermostat to the suction side of the coolant pump, a bypass effective as a line bypassing the radiator, said bypass connecting the outlet of the cooling jacket by way of a bypass valve of the mixing thermostat with the suction side of the coolant pump, one excess-pressure and vacuum valve means each for limiting the maximum and minimum pressures in the cooling circuit, and a coolant reservoir in an expansion tank open to the atmosphere for the compensation of changes in volume caused by pressure and temperature, as well as of evaporation and leakage losses, said expansion tank including at least one connecting line terminating in proximity of its bottom and connected to the cooling circuit by way of the excess-pressure and vacuum valve means, characterized in that the excess-pressure valve means is connected to the cooling circuit within the area of the cooling jacket of the engine and radiator, respectively, the area therebetween, and the vacuum valve means is connected to the cooling circuit between the radiator valve of the mixing thermostat and the suction side of the coolant pump.

2. A cooling circuit according to claim 1, characterized in that a vent line with a vent valve means leads to the expansion tank from a high point between the area of and including the cooling jacket and the radiator, said vent valve means opening by the effect of gravity and closing by the effect of the level height, the flow and/or the pressure of the coolant.

3. A cooling circuit according to claim 2, characterized in that the vent valve means is connected at the high point of the return water box of a cross-flow radiator.

4. A cooling circuit according to claim 2, characterized in that the vent valve means is constructed as a float valve in which at least at low excess pressure values, the product of sealing seat surface area and pressure difference acting thereon is smaller than the inherent weight of the float.

5. A cooling circuit according to claim 2, characterized in that a fine-screen filter is connected in series with the inflow side to at least one of the excess-pressure valve means, the vacuum valve means, and the vent valve means.

6. A cooling circuit according to claim 5, wherein a respective filter of relatively large area is series-connected to the inlet side of said excess pressure, vacuum and vent valve means.

7. A cooling circuit according to claim 5, characterized in that a vent line with a vent valve means leads to the expansion tank from a high point between the area of and including the cooling jacket and the radiator, said vent valve means opening by the effect of gravity and closing by the effect of the level height, the flow, and/or the pressure of the coolant.

8. A cooling circuit according to claim 5, characterized in that the vent valve means is connected at the high point of the return water box of a cross-flow radiator.

9. A cooling circuit according to claim 5, characterized in that the vent valve means is constructed as a float valve in which, at least at low excess pressure values, the product of sealing seat surface area and pressure difference acting thereon is smaller than the inherent weight of the float.

10. A cooling circuit according to claim 1, characterized in that a fine-screen filter is connected in series with the inflow side to at least one of the excess-pressure valve means, the vacuum valve means, and the vent valve means.

11. A cooling circuit according to claim 10, wherein a respective filter of relatively large area is series-connected to the inlet side of said excess pressure, vacuum and vent valve means.

* * * * *